US005353681A

United States Patent [19]

Sugg

[11] Patent Number: 5,353,681

[45] Date of Patent: Oct. 11, 1994

[54] RECOIL DAMPENING DEVICE FOR LARGE CALIBER WEAPONS

[76] Inventor: Ronald E. Sugg, 7800 Castlecomb Rd., Knoxville, Tenn. 37849

[21] Appl. No.: 31,961

[22] Filed: Mar. 16, 1993

[51] Int. Cl.[5] ..... F41A 25/16

[52] U.S. Cl. ..... 89/43.01; 89/177

[58] Field of Search ..... 42/1.06; 89/42.01, 43.01, 89/44.01, 44.02, 177, 178, 198

[56] References Cited

U.S. PATENT DOCUMENTS

| | | | |
|---|---|---|---|
| 689,283 | 12/1901 | Browning | 89/177 |
| 812,326 | 2/1906 | Browning | 89/177 |
| 2,679,192 | 5/1954 | Seeley et al. | 42/106 |
| 2,731,753 | 1/1956 | Mathieu | 42/74 |
| 2,788,714 | 4/1957 | Browning | 89/177 |
| 3,018,694 | 1/1962 | Browning | 89/159 |
| 3,105,411 | 10/1963 | Browning | 89/177 |
| 3,115,063 | 12/1963 | Browning | 89/177 |
| 3,208,348 | 9/1965 | Lee | 42/1.06 |
| 3,461,589 | 8/1969 | Vironda | 42/74 |
| 4,492,050 | 1/1985 | Kagehiro | 42/1.06 |
| 4,503,632 | 3/1985 | Cuevas | 42/1.06 |
| 4,635,530 | 1/1987 | Weldle | 89/177 |
| 4,833,808 | 5/1989 | Strahan | 42/1.06 |

OTHER PUBLICATIONS

Very High Power, FCSA Newsletter, 4th Qtr. 1992 Edition, The New Sugg-50 Rifle by Eric Williams pp. 4,5,28.

*Primary Examiner*—Stephen C. Bentley

*Attorney, Agent, or Firm*—Pitts & Brittian

[57] ABSTRACT

A recoil dampening device incorporating a dynamic braking system and index ring. The recoil dampening device of the present invention is intended for use on weapons, especially heavy caliber weapons, having a recoiling barrel. The recoil dampening device is coaxial with the weapon's barrel and has a constant pressure brake assembly and a dynamic brake assembly. The recoiling barrel and the brake assemblies are carried within a cylindrical tube that is coaxial with the brake assemblies and the barrel. As the weapon is discharged, the force of the recoil causes the barrel to travel rearwardly thus engaging a coaxial spring. The spring engages the dynamic brake assembly and as the barrel travels rearwardly, the force applied to the dynamic brake is increased in a linear fashion, causing an increasing amount of frictional braking pressure to be applied to the inner surface of the tube and the exterior surface of the barrel. When the frictional braking force exceeds the recoil force, the rearward travel of the recoiling barrel is halted and the energy stored within the spring returns the barrel to battery. Thus the acceleration of the recoil impulse is applied to the shooter through the frame of the weapon over a longer period of time thus reducing the perceived recoil force experienced by the shooter.

16 Claims, 3 Drawing Sheets

RECOIL DAMPENING DEVICE FOR LARGE CALIBER WEAPONS

TECHNICAL FIELD

This invention relates to the field of firearms. More particularly, it relates to a recoil dampening device for large caliber, shoulder-fired weapons.

BACKGROUND ART

Large caliber weapons produce significant recoil upon firing. The recoil produced by the such that a standard rifle chambered for this cartridge cannot be fired directly from the shoulder without a significant risk of recoil-induced injury to the shooter. However, in recent years, the popularity of the .50 BMG cartridge has risen among hobbyists, the para-military, as well as in various branches of the armed forces. Private manufacturers, such as Research Armament Industries and Barrett Firearms Manufacturing, Inc. have produced shoulder-fired rifles chambered for .50 BMG that incorporate various recoil absorbing devices. While these weapons have enjoyed a degree of popularity among hobbyists, the .50 BMG likely represents the upper threshold of recoil absorbance for these weapons. For instance, it is not likely that the recoil-absorbing technology within conventional weapons could easily be adapted to a shoulder-fired rifle chambered for the 20 mm Vulcan round or even the 14.5 mm Russian cartridge. What is needed is a recoil dampening device that would allow a shooter to shoulder-fire a rifle chambered for a cartridge as small as the .50 BMG cartridge or as large as the 20 mm Vulcan cartridge.

It is known that recoil is a result of the force generated by the gases that propel the projectile, or bullet, out of a weapon's barrel. The recoil force experienced by the shooter of a conventional weapon is a product of the acceleration of the recoil impulse generated by these gases and the amount of time that the recoil impulse is experienced by the shooter. In a conventional weapon this amount of time is approximately the time that elapses while the gases are expanding out of the barrel, i.e. the time necessary for the projectile to leave the open end of the barrel. In a conventional weapon this is approximately three milliseconds.

In U.S. Pat. No. 2,679,192, which issued on May 25, 1954, F. H. Seely et al. disclosed an invention entitled RECOIL REDUCING DEVICE FOR FIREARMS. Seely's recoil reducing device was a gas-operated device designed to apply a force, roughly equal to the amount of recoil, to the end of the barrel in the opposite direction from the recoil force. This was intended to cancel out the recoil force experienced by the shooter.

In U.S. Pat. No. 3,018,694, which issued on Jan. 30, 1962, V. A. Browning disclosed an invention entitled RECOIL ABSORBING MECHANISM FOR FIREARMS. Browning's device was a gas operated device designed to minimize recoil.

In U.S. Pat. Nos. 3,105,411 and 3,115,063, which issued on Oct. 1, 1963 and Dec. 24, 1963, respectively, Mr. Browning disclosed recoil absorbing mechanisms that were frictionally operated. Each of the Browning devices were designed to rapidly increase the resistance to the recoil over the period of time that the recoil forces were operating on the weapon, and thus initiate a progressive slowing down of the recoil movement. Thus, the Browning devices were dynamic in the sense that the recoil absorbance of the devices increased over time. Each of the Browning devices were coaxial with the firearms magazine.

In U.S. Pat. No. 3,208,348, which issued on Sept. 28, 1965, C. H. Lee disclosed an invention entitled GUN MUZZLE ATTACHMENT DEVICE FOR COUNTERACTING RECOIL. Lee's device operated on the venturi tube principle and caused the recoil gases to apply a force to the forward end of the barrel that was substantially equal to the recoil force and applied in an opposite direction to the recoil force. Lee's muzzle attachment was coaxial with the weapon's barrel. However, Lee's device is intended as a "choke" for shotgun type weapons and would not be useful or applicable to rifle type weapons.

In U.S. Pat. No. 4,833,808, which issued on May 30, 1989, T. Strahan disclosed an invention entitled ANTI-RECOIL DEVICE. Strahan's device was also a gas-operated device. This device threaded into the end of a modified barrel and was coaxial with the barrel. Strahan's device had ports that diverted a portion of the recoil gases towards a spring mounted weight, thus driving the weight forward. Thus, the weight applies a force to the forward end of the device that was substantially equal to the recoil force and that was applied in a direction opposite the recoil force, thus counteracting the recoil force.

In U.S. Pat. No. 812,326, which issued on Feb. 13, 1906. John Browning disclosed an invention entitled RECOIL BRAKE FOR AUTOMATIC GUNS. Mr. Browning's recoil brake consisted of contractile collar-brake which operated frictionally upon the magazine of the gun. This collar-brake consisted of a split collar having a beveled flange that coacted with a beveled shoulder carried disposed at the forward end of the magazine. As the barrel traveled rearwardly during recoil, the beveled shoulder engages the beveled flange of the split collar causing the split collar to contract against the magazine. However, Mr. Browning's muzzle brake was not coaxial with the barrel and did not apply any force outwardly against a supportive tube coaxial with the barrel.

Accordingly, it is an object of this invention to provide a recoil dampening device having a dynamic brake system which spreads the recoil force over a large period of time, thus effectively reducing the recoil force experienced by the shooter.

It is another object of the present invention to provide a recoil dampening device that is coaxial with the barrel of a weapon.

It is yet another object of the present invention to provide a recoil dampening device that generates an outward force, that is self-locating and self-compensating for wear and thermal changes, against a supporting tube coaxial with the barrel of a weapon.

Still another object of the present invention is to provide a recoil dampening device that accommodates the .50 BMG cartridge and larger cartridges, such as the 14.5 mm Russian and the 20 mm Vulcan cartridges, thus allowing these large cartridges to be comfortably fired from a shoulder-fired weapon.

Other objects and advantages over the prior art will become apparent to those skilled in the art upon reading the detailed description together with the drawings as described as follows.

DISCLOSURE OF THE INVENTION

In accordance with the various features of this invention, a recoil dampening device incorporating a dynamic braking system and index ring is provided. The recoil dampening device of the present invention is intended for use on weapons, especially heavy caliber weapons, in which, upon discharge of a cartridge, the barrel travels rearwardly as a result of the recoil force, i.e. a recoiling barrel. The recoil dampening device is coaxial with the weapon's barrel and is comprised of a constant pressure brake assembly disposed proximate the forward end of the barrel and a dynamic brake assembly disposed rearwardly of the constant pressure brake assembly. The barrel and the brake assemblies are carried within a cylindrical tube that is coaxial with the brake assemblies and the barrel. Each brake assembly applies a frictional braking force against the inner surface of the tube and against the external surface of the barrel. As the weapon is discharged, the force of the recoil causes the barrel to travel rearwardly against a spring member that is coaxial with the barrel. The spring engages the dynamic brake assembly and as the barrel travels rearwardly under the impetus of the recoil impulse, the force applied to the dynamic brake is increased in a linear fashion. This increase in force causes an increasing amount of frictional braking pressure to be applied to the inner surface of the tube and the exterior surface of the barrel. When the frictional braking force exceeds the recoil force, the rearward travel of the barrel is halted and the energy stored within the spring returns the barrel to the battery position ("battery"). Thus the acceleration of the recoil impulse is applied to the shooter through the frame of the weapon over a longer period of time thus reducing the perceived recoil force experienced by the shooter.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1A:
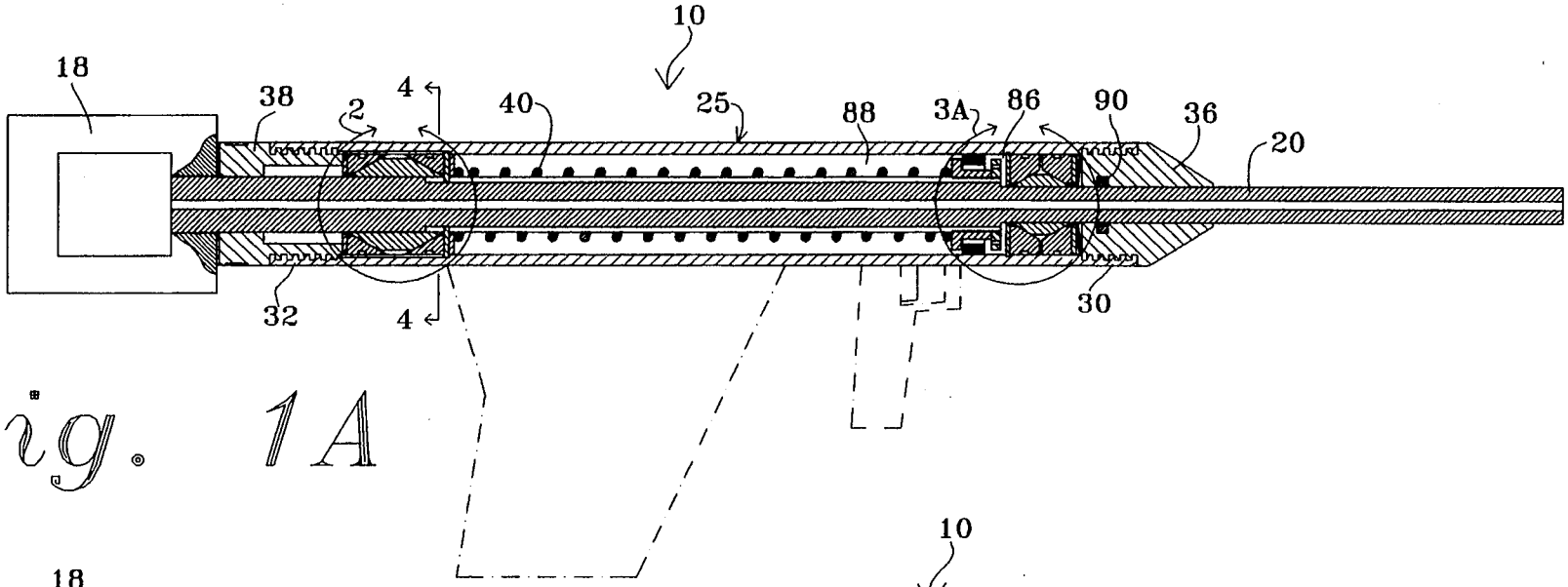
FIG. 1A illustrates a cross-sectional view of the recoil dampening device of the present invention with the barrel in the battery position. A stock and trigger guard are shown in phantom.
Figure 1B:
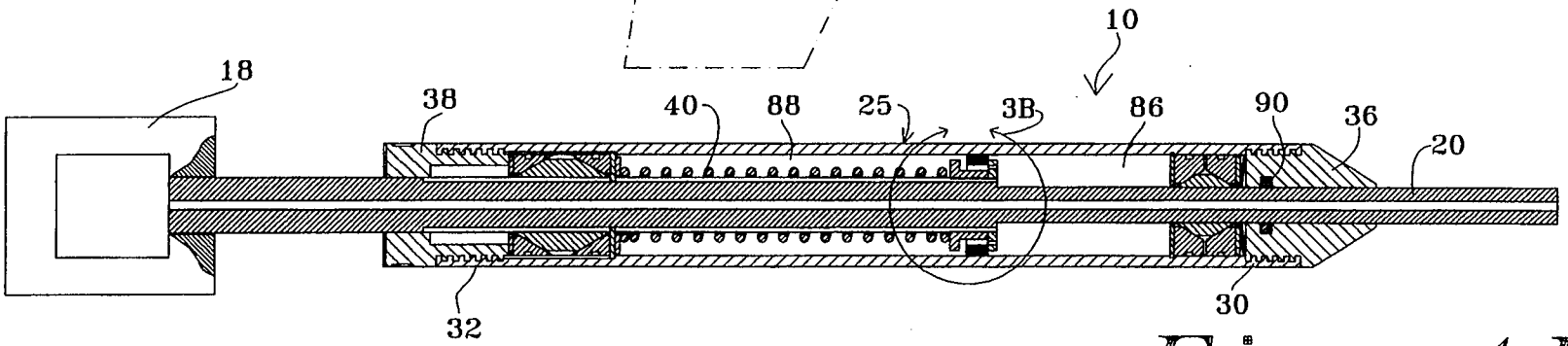
Figure 1B illustrates a cross-sectional view of the recoil dampening device of the present invention with the barrel in full recoil.

A recoil dampening device, constructed in accordance with the present invention is illustrated generally as 10 in the figures. While the recoil dampening device is illustrated embodied within a single shot breech loaded weapon, it will be appreciated by those skilled in the art, that the present invention would also be applicable in any type of firearm in which all or a portion of the barrel moves in recoil with relation to the frame of the weapon. Illustrated is a rifle having a breech loaded firing mechanism 18, a barrel 20 and a tube frame 25. In the preferred embodiment, the barrel 20 and the tube frame 25 are constructed of titanium and machined aluminum respectively. A shoulder stock and trigger guard, (each shown in phantom in FIG. 1A), are secured to tube frame 25, such that tube frame 25 is carried over the shooter's shoulder. During the recoil impulse, barrel 20 travels rearwardly within tube frame 25 from the battery position, shown in FIG. 1A, to a full recoil position, shown in Fig. 1B. At the conclusion of the recoil impulse, barrel 20 returns to battery. In the preferred embodiment, tube frame 25 has a cylindrical tube body 28 which is coaxial with barrel 20. Tube body 28 has a forward end 30 and a rearward end 32. Preferably, forward end 30 and rearward end 32 are provided with internal, square or "acme" threads. The threads disposed at the forward end 30 of tube body 28 interact with external acme threads disposed on forward end cap 36, while the threads disposed at the rearward end 32 of tube body 28 interact with external threads disposed on rearward end cap 38. While any configuration of threading for tubing body 28, forward end cap 36 and rearward end cap 38 would suffice, acme threads are utilized in order to minimize the risk of cross-threading. Forward end cap 36 and rearward end cap 38 are, like tube body 28, coaxial with barrel 20 and each have a centrally disposed opening through which barrel 20 extends.

Those skilled in the art will recognize that, due to the rifling commonly found in a rifle barrel, a substantial amount of torque is applied to barrel 20. In order to prevent barrel 20 from spinning about its longitudinal axis within tube body 28, an index ring 72 is provided. Index ring 72 is coaxial with barrel 20 and with tube body 28 and is provided with at least one and preferably a plurality of internal splines 74 which engage registering longitudinal grooves 75 provided along the exterior surface of barrel 20 and at least one and preferably a plurality of external splines 76 which engage registering longitudinal grooves 77 provided along the interior surface of tube body 28. Index ring 72 is preferably constructed of a material that will not abrade barrel 20 or tube body 28 and most preferably is constructed of bronze.

Figure 2:
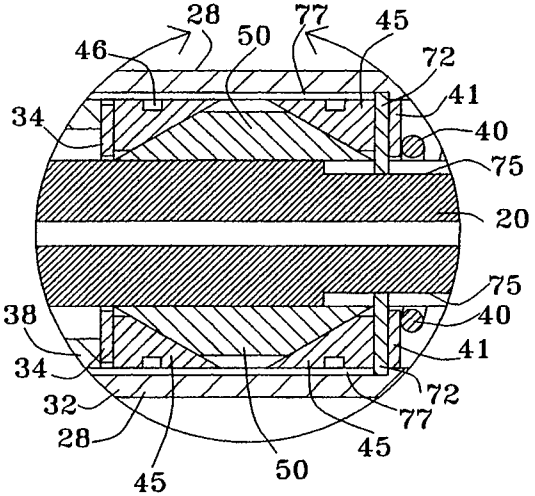
FIG. 2 illustrates an enlarged view of the area surrounded by circle 2 showing the coaxial dynamic brake assembly of the recoil dampening device of the present invention.
Figure 5:
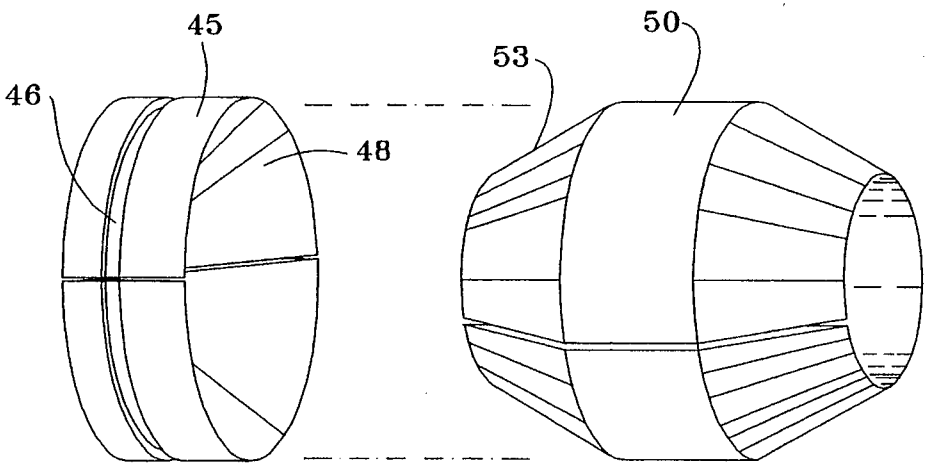
FIG. 5 is a perspective view of one of the expansion rings and co-acting compression ring utilized according to the present invention.
Figure 4:
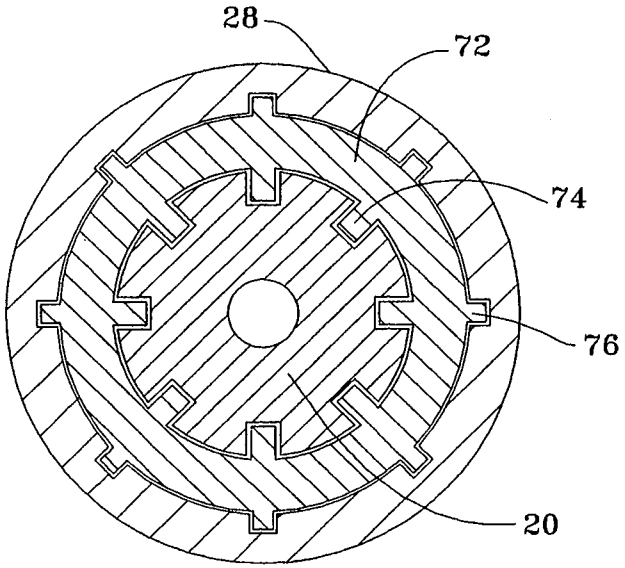
FIG. 4 illustrates a cross-sectional view of the device of the present invention taken along line 4—4 in FIG. 1.

In a conventional weapon, the recoil impulse is distributed to the shooter in approximately 3/1000's of a second. In order to spread the recoil impulse over a longer period of time, a coaxial dynamic braking system is utilized by the present invention. The dynamic braking system is coaxial with tube frame 25 and barrel 20 and comprises a dynamic brake assembly, shown in detail in FIG. 2 a spring 40, a spring retainer 42 threadably secured to barrel 20 forward of spring 40 and a one-way pneumatic valve which is shown in detail in FIGS. 3A and 3B. Each component, the dynamic brake assembly, spring 40, spring retainer 42 and the one-way pneumatic valve assembly is coaxial with tube body 28 and barrel 20. When assembled, spring 40 applies approximately eighteen to twenty-five pounds of spring pressure to the dynamic brake assembly.

The dynamic brake assembly comprises a pair of expansion rings 45 and an interfitting compression ring 50 and is disposed at the rearward end of tube body 32. One side of each expansion ring 45 has a concave or internal frusto-conical surface 48 having the same angle as and coacting with a convex or external frusto-conical end 53 of compression ring 50. In the preferred embodiment, the angle of internal frusto-conical surface 48 defines a self-releasing taper in the range of approximately 20°–35° and is most preferably 25°. The opposite side of each of the expansion rings 45 is flat. The compression ring 50 is severed longitudinally and the expansion rings 45 are severed longitudinally in one or more places so as to be capable of being inwardly and outwardly, respectively, distorted radially. In the preferred embodiment, expansion ring 45 has a plurality of longitudinal cuts and is provided with an annular groove 46. For purposes of maintaining the segments of expansion ring 45 in the proper geometric alignment during assembly and disassembly of the weapon a loose segment-retaining ring (not shown) can be provided. Disposed between the dynamic brake assembly and rearward end cap 38 is a flat washer 34 that serves to protect the end of rearward end cap 38 from being abraded by the radial flexing of expansion ring 45. In the preferred embodiment, expansion rings 45 are constructed of titanium, chosen for its high shear resistance and light weight. Preferably compression ring 50 is constructed of bearing bronze so as not to abrade barrel 20.

Spring 40 is selected so as to provide approximately twenty pounds of spring pressure against the dynamic brake assembly when barrel 20 is at battery and approximately eighty pounds of spring pressure against dynamic brake assembly when barrel 20 is in full recoil. As the weapon is fired, the recoil impulse drives barrel 20 rearwardly. Spring retainer 42 engages and compresses spring 40 against a second flat washer 41. This exerts a force against expansion ring 45. As barrel 20 travels rearwardly the force applied to expansion ring 45 by spring 40 increases in a linear fashion. As force is applied to expansion ring 45, expansion ring 45 is forced over compression ring 50. This causes expansion ring 45 to distort outward radially, applying a an increasing amount of self-locating braking force against the interior surface of tube body 28. Simultaneously, compression ring 50 is caused to distort inward radially, applying a frictional braking force against the exterior surface of barrel 20. The linear increase in force applied by the rearward travel of barrel 20 causes an increasing amount of braking pressure to be applied to the inner surface of tube body 28 and, likewise, increases the frictional braking force applied to the exterior surface of barrel 20. At the time the frictional braking force exceeds the rearward acceleration of barrel 20, the rearward motion of barrel 20 is halted and the resulting kinetic energy stored in spring 40 returns the barrel to battery. The shooter experiences the recoil impulse over a period of time that is approximately one-third of a second.

Figure 3B:
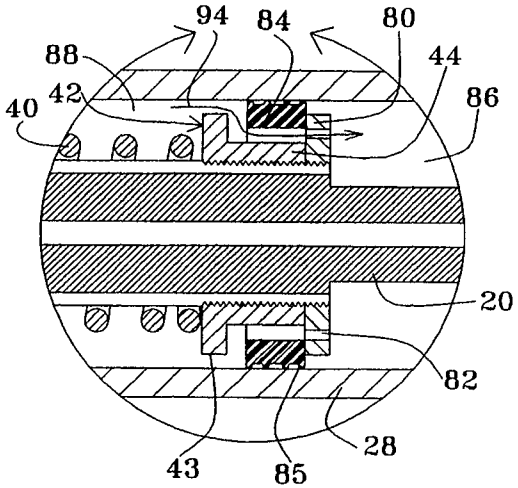
FIGS. 3A and 3B illustrate an enlarged view of the area surrounded by circles 3A–3B showing the coaxial constant pressure brake assembly and one-way pneumatic valve of the recoil dampening device of the present invention.
Figure 3A:
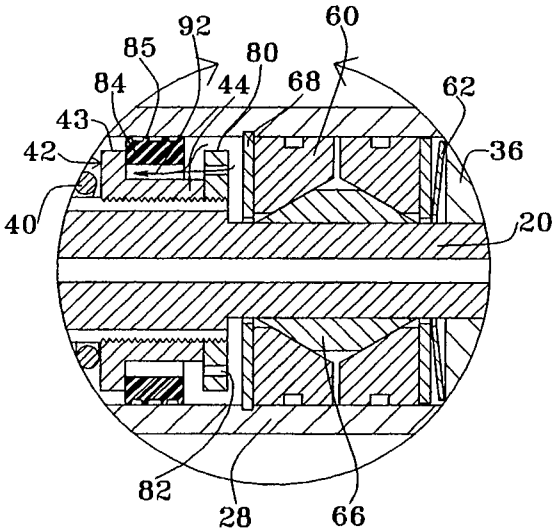

It will be recognized that as spring 40 returns barrel 20 to battery, an additional force is exerted against the shooter. While this force is manageable, a one-way pneumatic valve assembly for slowing the return of barrel 20 to battery is utilized in the preferred embodiment. In the preferred embodiment, the one-way pneumatic valve assembly is coaxial with barrel 20 and tube body 28. Referring to FIGS. 3A and 3B, it will be seen that spring retainer 42 is substantially L-shaped in cross-section having a first leg 43 and a second leg 44 and is threadably secured to barrel 20 adjacent the forward end of spring 40. Spring retainer 42 is dimensioned so as to provide an air gap between first leg 43 of spring retainer 42 and the interior surface of tube body 28. Adjacent the forward end of second leg 44 of spring retainer 42 is a perforated flat ring 80. In the preferred embodiment, perforated flat ring 80 is provided with a plurality of holes 82. Like spring retainer 42, perforated flat ring 80 is threadably secured to barrel 20. A sealing ring 84 is sandwiched between spring retainer 42 and perforated flat ring 80. Sealing ring 84 is dimensioned so as to provide an air-tight seal between sealing ring 84 and the interior surface of tube body 28 while providing an air gap between sealing ring 84 and the second leg 44 of spring retainer 42. In the preferred embodiment, sealing ring 84 is constructed from TEFLON and is provided with annular protrusions 85 which form an air tight-seal against the interior surface of tube body 28. The holes 82 in perforated flat ring 80 are selectively positioned so as not to be covered by sealing ring 84 when sealing ring 84 is positioned against perforated flat ring 80.

The one-way pneumatic valve assembly divides the interior of tube body 28 into a forward air chamber 86 and a rearward air chamber 88. As barrel 20 travels rearwardly during recoil, sealing ring 84 engages perforated flat ring 80 and air is allowed to travel freely from rearward air chamber 88, between first leg 43 of spring retainer 42 and the interior surface of tube body 28, through holes 82, in the direction of arrow 94, and into the rapidly enlarging forward air chamber 86. However, as barrel 20 returns to battery, sealing ring 84 engages first leg 43 of spring retainer 42 and prevents backflow of air from forward air chamber 86 to rearward air chamber 88, see arrow 92, as barrel 20 returns to battery. This impediment to air flow momentarily compresses the air within forward air chamber 86 and cushions and slows the return of barrel 20 to battery while the air leaks through the components of the constant force brake assembly and through the junction between forward end cap 36 and tube body 28. To prevent air from rapidly leaking through the junction between forward end cap 36 and barrel 20, and thus reducing the efficiency of the one-way pneumatic valve assembly, forward end cap 36 is provided with an O-ring 90 which provides a substantially air-tight seal between forward end cap 36 and barrel 20. O-ring 90 is preferably constructed of polyethylene. It will be recognized by those skilled in the art that alternate configurations could be designed to prevent backflow of air from forward air chamber 86 to rearward air chamber 88. The use of a one-way pneumatic valve assembly extends the time that the shooter experiences the recoil impulse from approximately one-third of a second to better than a second. It will be further understood that sealing ring 84 frictionally engages the interior of tube body 28 and frictionally slides along the interior surface of tube body 28 as barrel 20 recoils and returns to battery. Thus in the preferred embodiment, sealing ring 84 is constructed of a lightweight material that is highly nonabrasive and will maintain an air-tight seal against the interior of tube body 28.

In order to maintain concentricity between barrel 20 and tube body 28 while barrel 20 is at battery and during recoil, a coaxial constant pressure brake assembly comprising a second pair of expansion rings 60 and interfitting compression ring 66 is disposed within the forward end of tube body 28 and is engaged by forward end cap 36. Expansion ring 60 and compression ring 66 are constructed the same as, and function similarly to expansion ring 45 and compression ring 50 described above and are coaxial with barrel 20. However, rather than applying dynamic frictional braking pressure, i.e. frictional braking pressure that changes actively, expansion ring 60 and compression ring 66 apply a slight, constant braking force to barrel 20 and the interior surface of forward end of tube body 28. Constant pressure is maintained by compressing the pair of expansion rings 60 against compression ring 66 by means of a spring washer 62 adjacent to forward end cap 36 and a snap ring 68 carried at the forward end 30 of tube body 28. Similar to their counterparts in the dynamic brake assembly, expansion rings 60 are preferably constructed of titanium and compression ring 66 is preferably constructed of bearing bronze.

It will be recognized by those skilled in the art that the exterior surface of the barrel can be beveled in areas that are not engaged by either of the brake assemblies for the purpose of saving weight. However, as the weight of the barrel decreases or as the caliber of the weapon increases, a longer distance of barrel travel must be allowed for within tube body 28 and/or the spring rate must be increased.

From the foregoing description, it will be recognized by those skilled in the art that a recoil dampening device for large caliber weapons offering advantages over the prior art has been provided. Specifically, the recoil dampening device for large caliber weapons provides a recoil dampening device having a dynamic brake system which spreads the recoil impulse over a longer period of time, thus effectively reducing the recoil force experienced by the shooter. The present invention also provides a recoil dampening device that is coaxial with the barrel of a weapon and that generates a frictional braking force outwardly against a supporting tube coaxial with the barrel of a weapon. The recoil dampening device of the present invention provides a recoil dampening device that accommodates the .50 BMG cartridge and larger cartridges, such as the 14.5 mm Russian and the 20 mm Vulcan cartridges, thus allowing these large cartridges to be comfortably fired from a shoulder-fired weapon.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A recoil dampening device for a large caliber weapon, said large caliber weapon having a frame, a firing mechanism and a recoiling barrel having an exterior surface, said frame having a member for being held by a shooter, wherein when said firing mechanism discharges a round a recoil impulse is generated causing said recoiling barrel to travel rearwardly, wherein said recoil dampening device comprises:

a tube body carried by said frame, wherein said tube body is coaxial with said recoiling barrel, said tube body having a substantially cylindrical interior surface, a forward end and a rearward end wherein said interior surface is provided with at least one longitudinal groove;

a forward end cap threadably secured to said forward end of said tube body and a rearward end cap threadably secured to said rearward end of said tube body, wherein said recoiling barrel extends through said forward and said rearward end caps;

at least one longitudinal groove carried by said exterior surface of said recoiling barrel;

an index ring coaxial with said recoiling barrel and with said tube body, wherein said index ring is provided with at least one internal spline which is registered with and engages said at least one longitudinal groove carried by said exterior surface of said recoiling barrel and at least one external spline which is registered with and engages said at least one longitudinal groove provided on said interior surface of said tube body;

a spring carried within said tube body wherein said spring is coaxial with said recoiling barrel wherein said spring has a forward end and a rearward end;

a spring retainer threadably secured to said recoiling barrel adjacent to said forward end of said spring wherein said spring retainer engages and compresses said spring as said recoiling barrel travels rearwardly during recoil and wherein said spring returns said recoiling barrel to battery after said recoil;

a dynamic brake assembly coaxial with said recoiling barrel and adjacent to said rearward end of said spring wherein as said recoiling barrel travels rearwardly during said recoil, said spring retainer engages said spring and compresses said spring against said dynamic brake assembly thereby exerting an increasing amount of pressure against said dynamic brake assembly whereby said dynamic brake assembly produces an increasing amount of frictional braking force against said exterior surface of said recoiling barrel and against said interior surface of said tube body; and a constant force brake assembly for maintaining a constant frictional force against said exterior surface of said recoiling barrel and against said interior surface of said forward end of said tube body, wherein said constant force brake assembly is coaxial with said recoiling barrel thereby maintaining said forward end of said tube body in coaxial alignment with said recoiling barrel.

2. The recoil dampening device of claim 1 wherein said forward end of said tube body is provided with internal threads which interact with external threads disposed on said forward end cap and said rearward end of said tube body is provided with internal threads which interact with external threads disposed on said rearward end cap.

3. The recoil dampening device of claim 2 wherein said internal threads and said external threads are acme threads.

4. The recoil dampening device of claim 1 wherein said recoil dampening device further comprises a one-way pneumatic valve assembly coaxial with said recoiling barrel for allowing exchange of air from a rearward air chamber within said tube body to a forward air chamber within said tube body as said recoiling barrel travels rearwardly during recoil and which substantially restricts backflow of said air from said forward air chamber to said rearward air chamber as said recoiling barrel returns to battery thus compressing said air within said forward air chamber and thereby cushioning and slowing return of said recoiling barrel to battery.

5. The recoil dampening device of claim 1 wherein said large caliber weapon is chambered for .50 BMG cartridge.

6. The recoil dampening device of claim 1 wherein said large caliber weapon is chambered for 14.5 mm Russian cartridge.

7. The recoil dampening device of claim 1 wherein said large caliber weapon is chambered for 20 mm Vulcan cartridge.

8. The recoil dampening device of claim 1 wherein said tube body and said tube frame are constructed of machined aluminum.

9. The recoil dampening device of claim 1 wherein said dynamic brake assembly has a forward and a rearward expansion ring and a compression ring, said compression ring having first and second frusto-conical beveled ends, each said expansion ring provided with an internal frusto-conical surface having the same angle as and coacting with said external frusto-conical beveled ends of said compression ring, and an oppositely disposed flat side, and further wherein said compression ring and each said expansion ring are severed in at least one place so as to be capable of being inwardly and outwardly, respectively, distorted radially.

10. A recoil dampening device for a large caliber weapon, said large caliber weapon having a frame, a firing mechanism and a recoiling barrel having an exterior surface, said frame having a member for being held by a shooter, wherein when said firing mechanism discharges a round a recoil impulse is generated causing said recoiling barrel to travel rearwardly, wherein said recoil dampening device comprises:

a tube body carried by said tube frame, wherein said tube body is coaxial with said recoiling barrel, said tube body having a substantially cylindrical interior surface, a forward end and a rearward end wherein said interior surface is provided with at least one longitudinal groove;

a forward end cap threadably secured to said forward end of said tube body and a rearward end cap threadably secured to said rearward end of said tube body, wherein said recoiling barrel extends through said forward and said rearward end caps;

at least one longitudinal groove carried by said exterior surface of said recoiling barrel;

an index ring coaxial with said recoiling barrel and with said tube body, wherein said index ring is provided with at least one internal spline which is registered with and engages said at least one longitudinal groove carried by said exterior surface of said recoiling barrel and at least one external spline which is registered with and engages said at least one longitudinal groove provided on said interior surface of said tube body;

a spring carried within said tube body wherein said spring is coaxial with said recoiling barrel wherein said spring has a forward end and a rearward end;

a spring retainer threadably secured to said recoiling barrel adjacent to said forward end of said spring wherein said spring retainer engages and compresses said spring as said recoiling barrel travels rearwardly during recoil and wherein said spring returns said recoiling barrel to battery after said recoil;

a dynamic brake assembly having a forward and a rearward expansion ring and a compression ring, said compression ring having first and second frusto-conical beveled ends, each said expansion ring provided with an internal frusto-conical surface having the same angle as and coacting with said external frusto-conical beveled ends of said compression ring, and an oppositely disposed flat side, wherein said compression ring and each said expansion ring are severed in at least one place so as to be capable of being inwardly and outwardly, respectively, distorted radially, wherein said expansion rings and said compression ring are coaxial with said recoiling barrel, and further wherein said forward expansion ring is adjacent to said rearward end of said spring wherein as said recoiling barrel travels rearwardly during said recoil, said spring retainer engages said spring and compresses said spring against said forward expansion ring thereby exerting an increasing amount of pressure against said dynamic brake assembly whereby said dynamic brake assembly produces an increasing amount of frictional braking force against said exterior surface of said recoiling barrel and against said interior surface of said tube body;

a constant force brake assembly for maintaining a constant frictional force against said exterior surface of said recoiling barrel and against said interior surface of said forward end of said tube body, wherein said constant force brake assembly is coaxial with said recoiling barrel thereby maintaining said forward end of said tube body in coaxial alignment with said recoiling barrel; and a one-way pneumatic valve assembly coaxial with said recoiling barrel for allowing exchange of air from a rearward air chamber within said tube body to a forward air chamber within said tube body as said recoiling barrel travels rearwardly during recoil and which substantially restricts backflow of said air from said forward air chamber to said rearward air chamber as said recoiling barrel returns to battery thus compressing said air within said forward air chamber and thus cushioning and slowing return of said recoiling barrel to battery.

11. The recoil dampening device of claim 10 wherein said forward end of said tube body is provided with internal threads which interact with external threads disposed on said forward end cap and said rearward end of said tube body is provided with internal threads which interact with external threads disposed on said rearward end cap.

12. The recoil dampening device of claim 11 wherein said internal threads and said external threads are acme threads.

13. The recoil dampening device of claim 10 wherein said large caliber weapon is chambered for .50 BMG cartridge.

14. The recoil dampening device of claim 10 wherein said large caliber weapon is chambered for 14.5 mm Russian cartridge.

15. The recoil dampening device of claim 10 wherein said large caliber weapon is chambered for 20 mm Vulcan cartridge.

16. The recoil dampening device of claim 10 wherein said tube body and said tube frame are constructed of machined aluminum.

* * * * *